US009088115B2

(12) United States Patent
Komoto et al.

(10) Patent No.: US 9,088,115 B2
(45) Date of Patent: Jul. 21, 2015

(54) CONNECTOR

(71) Applicant: JAPAN AVIATION ELECTRONICS INDUSTRY, LIMITED, Shibuyaku, Tokyo (JP)

(72) Inventors: Tetsuya Komoto, Tokyo (JP); Ryuzo Shimeno, Tokyo (JP); Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/242,447

(22) Filed: Apr. 1, 2014

(65) Prior Publication Data

US 2014/0302696 A1 Oct. 9, 2014

(30) Foreign Application Priority Data

Apr. 3, 2013 (JP) ..... 2013-078084

(51) Int. Cl.

| | |
|---|---|
| ***H01R 13/15*** | (2006.01) |
| ***H01R 12/79*** | (2011.01) |
| ***H01R 12/77*** | (2011.01) |
| *H01R 12/88* | (2011.01) |

(52) U.S. Cl.

CPC ..... *H01R 12/79* (2013.01); *H01R 12/774* (2013.01); *H01R 12/88* (2013.01)

(58) Field of Classification Search

CPC .... H01R 13/2414; H01R 12/52; H01R 12/61; H01R 12/7082; H01R 12/774; H01R 12/79; H01R 12/88; H01R 12/592; H01R 12/78; H01R 12/62; H01R 12/721; H01R 23/661; H01R 12/716; H01R 13/506; H01R 23/66

USPC ..... 439/265, 493, 495, 496, 67, 77, 884, 439/862

See application file for complete search history.

(56) References Cited

U.S. PATENT DOCUMENTS

| | | | | |
|---|---|---|---|---|
| 7,929,110 | B2 * | 4/2011 | Novak et al. | 355/53 |
| 8,002,567 | B2 * | 8/2011 | Hara | 439/329 |
| 8,662,915 | B2 * | 3/2014 | Ueda et al. | 439/493 |
| 8,840,411 | B2 * | 9/2014 | Nakano | 439/260 |
| 8,851,918 | B2 * | 10/2014 | Yoshisuji et al. | 439/350 |

FOREIGN PATENT DOCUMENTS

JP 09-161909 A 6/1997

* cited by examiner

*Primary Examiner* — Xuong Chung Trans
(74) *Attorney, Agent, or Firm* — Holtz, Holtz, Goodman & Chick PC

(57) ABSTRACT

A connector capable of dispensing an actuator and reducing manufacturing costs. The connector includes a metal plate for sandwichingly supporting an FPC. The metal plate includes a first supporting portion mounted on a printed wiring board, and a second supporting portion connected to the first supporting portion via a linking portion in a manner movable in an FPC sandwiching direction. The second supporting portion includes a second movable portion opposed to the first supporting portion, and a second spring portion for causing the second movable portion to be urged against the inserted FPC. The second supporting portion includes a pair of locking pieces. The locking pieces cause the second movable portion to move away from the first supporting portion, using an FPC inserting force to increase distance between contact point portions of the first and second supporting portions, and prevent removal of the FPC.

20 Claims, 20 Drawing Sheets

CONNECTOR

BACKGROUND OF THE INVENTION

1. Field of the Invention

This invention relates to a connector.

2. Description of the Related Art

Conventionally, as shown in FIGS. 19, 20A, and 20B, there has been known a connector which comprises a metal plate 901 including a pair of sandwiching pieces 906A, insulating layers 903 formed on opposite surfaces of the metal plate 901, a plurality of parallel conductive strips 904 thermocompression-bonded to the surfaces of the insulating layers 903, and means for opening and closing the pair of sandwiching pieces 906A (see Japanese Laid-Open Patent Publication (Kokai) No. H09-161909 (paragraphs 0013, 0018 to 0027, FIGS. 3, 4A and 4B, etc.).

The metal plate 901 is bent into a U-shape to form the pair of sandwiching pieces 906A such that they can sandwich a wiring board 905 to be connected. An end of one of the sandwiching pieces 906A is bent such that the to-be-connected wiring board 905 can be pushed under the bent end, thereby being formed with a pressurizing portion 906C. Ends of associated ones of the parallel conductive strips 904 are arranged on a surface of the pressurizing portion 906C, thereby forming pressurizing terminals 904A.

The associated ones of the parallel conductive strips 904 are thermocompression-bonded to an outer surface of one sandwiching piece 906A via the associated insulating layer 903 formed on one surface of the metal plate 901. One end of each parallel conductive strip 904 is bent in a manner liberated from a linking piece 906B, for forming a surface-mounting terminal 904B.

The others of the parallel conductive strips 904 are thermocompression-bonded to an inner surface of the other sandwiching piece 906A via the associated insulating layer 903 formed on the other surface of the metal plate 901. One end of each thermocompression-bonded parallel conductive strip 904 protrudes from an edge of the other sandwiching piece 906A, for forming a surface-mounting terminal 904C. An end of the other sandwiching piece 906A protrudes forward of the pressurizing portion 906C, for forming a guiding piece 906D.

The above-described connector is surface-mounted on a mounting wiring board 907 (see FIGS. 20A and 20B). In doing this, the surface-mounting terminal 904B formed by bending one end of the one parallel conductive strip 904 is soldered to the mounting wiring board 907, and the surface-mounting terminal 904C formed by protruding one end of the other parallel conductive strip 904 is soldered to the mounting wiring board 907.

Further, the means (actuator) for opening and closing the pair of sandwiching pieces 906A comprises an opening/closing shaft 908 rotatably accommodated between the sandwiching pieces 906A, and an operating arm 908C formed on an end of the opening/closing shaft 908 (see FIG. 19).

The opening/closing shaft 908 has an elliptic cross section (see FIGS. 20A and 20B). When the operating arm 908C is operated to rotate the opening/closing shaft 908, a crest 908A of the opening/closing shaft 908 is brought into contact with the inner surface of the pair of sandwiching pieces 906A to expand space between the sandwiching pieces 906A (see FIG. 20A), whereby a gap between the pressurizing terminal 904A on the side of the one sandwiching piece 906A and the pressurizing terminal 904A on the side of the other sandwiching piece 906B is made larger than the thickness of the to-be-connected wiring board 905 (a state where between the pair of sandwiching pieces 906A are open). This makes it possible to insert the to-be-connected wiring board 905 between the sandwiching pieces 906A without any load.

When the opening/closing shaft 908 is rotated from the state where the pair of sandwiching pieces 906A are open, the crest 908A of the opening/closing shaft 908 is moved away from the inner surface of the pair of sandwiching pieces 906A, and a trough 908B of the opening/closing shaft 908 is opposed to the inner surfaces of the pair of sandwiching pieces 906A (see FIG. 20B), whereby a gap is formed between the opening/closing shaft 908 and the inner surfaces of the pair of sandwiching pieces 906A. As a consequence, the space between the pressurizing terminal 904A on the side of the one sandwiching piece 906A and the pressurizing terminal 904A on the side of the other sandwiching piece 906A is made narrower (a state where the pair of sandwiching pieces 906A is closed), and the to-be-connected wiring board 905 is sandwiched by the pair of sandwiching pieces 906A via the pressurizing terminals 904A, whereby the to-be-connected wiring board 905 and the mounting wiring board 907 are electrically connected.

The above-described connector includes, besides the metal plate 901, an actuator formed separately therefrom, as a component thereof, which is a cause of an increase in the manufacturing costs of the connector.

SUMMARY OF THE INVENTION

The present invention has been made in view of these circumstances, and an object thereof is to provide a connector that is capable of dispensing with an actuator, thereby reducing the manufacturing costs of the connector.

To attain the above object, the present invention provides a connector that electrically connects a plate-shaped object to be connected and an other object to be connected to each other, comprising a metal plate for supporting the plate-shaped object to be connected in a sandwiching manner, the metal plate including a first supporting portion mounted on the other object to be connected, and a second supporting portion linked to the first supporting portion via a linking portion in a manner movable in a direction of sandwiching the plate-shaped object to be connected, the second supporting portion including a second movable portion opposed to the first supporting portion, a second spring portion for causing the second movable portion to be urged against the plate-shaped object to be connected when the plate-shaped object to be connected is inserted between the first supporting portion and the second supporting portion, and a force application portion for causing the second movable portion to move in a direction away from the first supporting portion to thereby increase a distance between the first supporting portion and the second supporting portion, when the plate-shaped object to be connected is inserted between the first supporting portion and the second movable portion against a returning force of the second spring portion, and for causing the second movable portion to move in a direction of approaching the first supporting portion, when insertion of the plate-shaped object to be connected is completed, and a plurality of conductive path portions formed on the metal plate with an insulating layer provided therebetween, wherein at least one of the first supporting portion and the second supporting portion has a protruding portion formed thereon which presses part of the conductive path portions against the plate-shaped object to be connected which has been inserted between the first supporting portion and the second movable portion.

Preferably, the force application portion is disposed forward of the protruding portion in a front-rear direction of the connector.

Preferably, the first supporting portion includes a first supporting portion body opposed to the second supporting portion in the direction of sandwiching the plate-shaped object to be connected, a fixing portion fixed to the other object to be connected, a first linking portion that links between the first supporting portion body and the fixing portion, and a hold-down portion fixed to the other object to be connected, for supporting the first supporting portion body.

Preferably, the first supporting portion includes a first movable portion opposed to the second supporting portion, a fixing portion fixed to the other object to be connected, and a first spring portion linked to the fixing portion via the first linking portion in a manner movable in the direction of sandwiching the plate-shaped object to be connected, for causing the first movable portion to be urged against the plate-shaped object to be connected when the plate-shaped object to be connected is inserted between the second supporting portion and the first movable portion.

Preferably, the second supporting portion includes a locking portion for maintaining a state in which insertion of the plate-shaped object to be connected has been completed.

More preferably, the locking portion also serves as the force application portion.

Preferably, the protruding portion is formed on each of the first supporting portion and the second supporting portion, and the protruding portion formed on the first supporting portion and the protruding portion formed on the second supporting portion are opposed to each other in the direction of sandwiching the plate-shaped object to be connected.

Preferably, the first supporting portion includes a pair of side wall portions for suppressing displacement of the plate-shaped object to be connected in a direction of arranging the conductive path portions.

Preferably, the first supporting portion, the second supporting portion, and the linking portion are integrally formed with each other.

Preferably, the metal plate is S-shaped, as viewed from a direction of arranging the conductive path portions, and the first supporting portion is U-shaped, as viewed from the direction of arranging the conductive path portions.

Preferably, the metal plate is U-shaped, as viewed from a direction of arranging the conductive path portions, and the first supporting portion is I-shaped, as viewed from the direction of arranging the conductive path portions.

According to the present invention, it is possible to provide a connector that is capable of dispensing with an actuator, thereby reducing the manufacturing costs of the connector.

The above and other objects, features and advantages of the present invention will become more apparent from the following detailed description taken in conjunction with the accompanying drawings.

BRIEF DESCRIPTION OF THE DRAWINGS

FIGS. 20A and 20B are cross-sectional views of the open and closed states of the connector shown in FIG. 19, in which FIG. 20A shows the open state of the connector, and FIG. 20B shows the closed state of the same.

DETAILED DESCRIPTION OF THE PREFERRED EMBODIMENTS

The present invention will now be described in detail with reference to the drawings showing preferred embodiments thereof.

First, a description will be given of a connector 1 according to an embodiment of the present invention, with reference to FIGS. 1 to 13.

Figure 6:
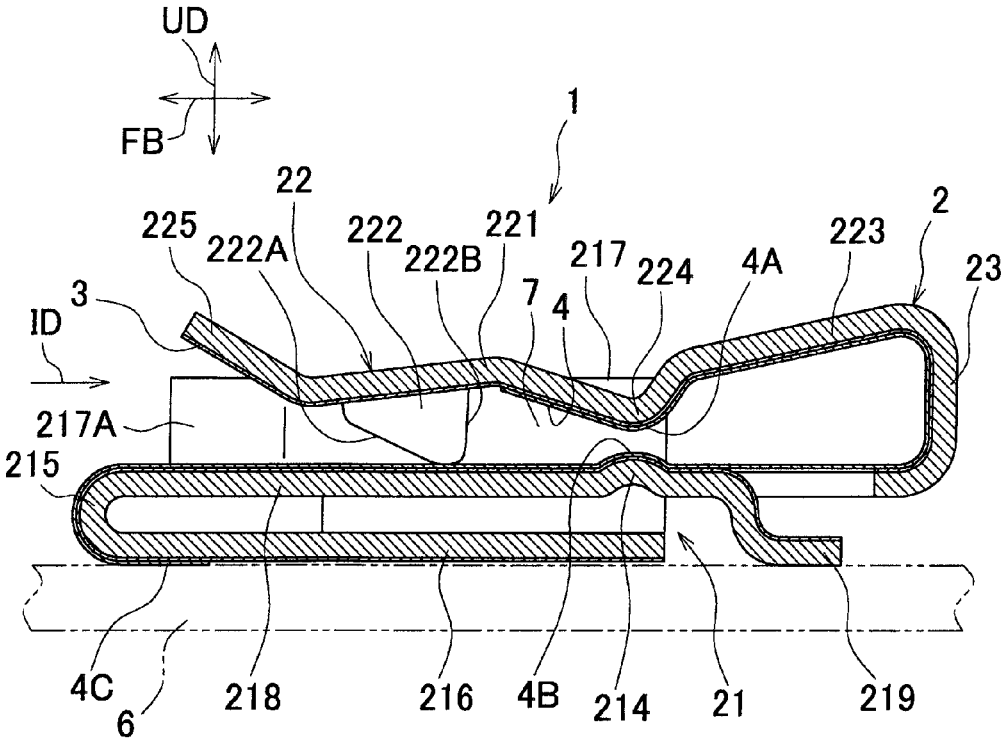
FIG. 6 is a cross-sectional view taken along VI-VI in FIG. 2.
Figure 8:
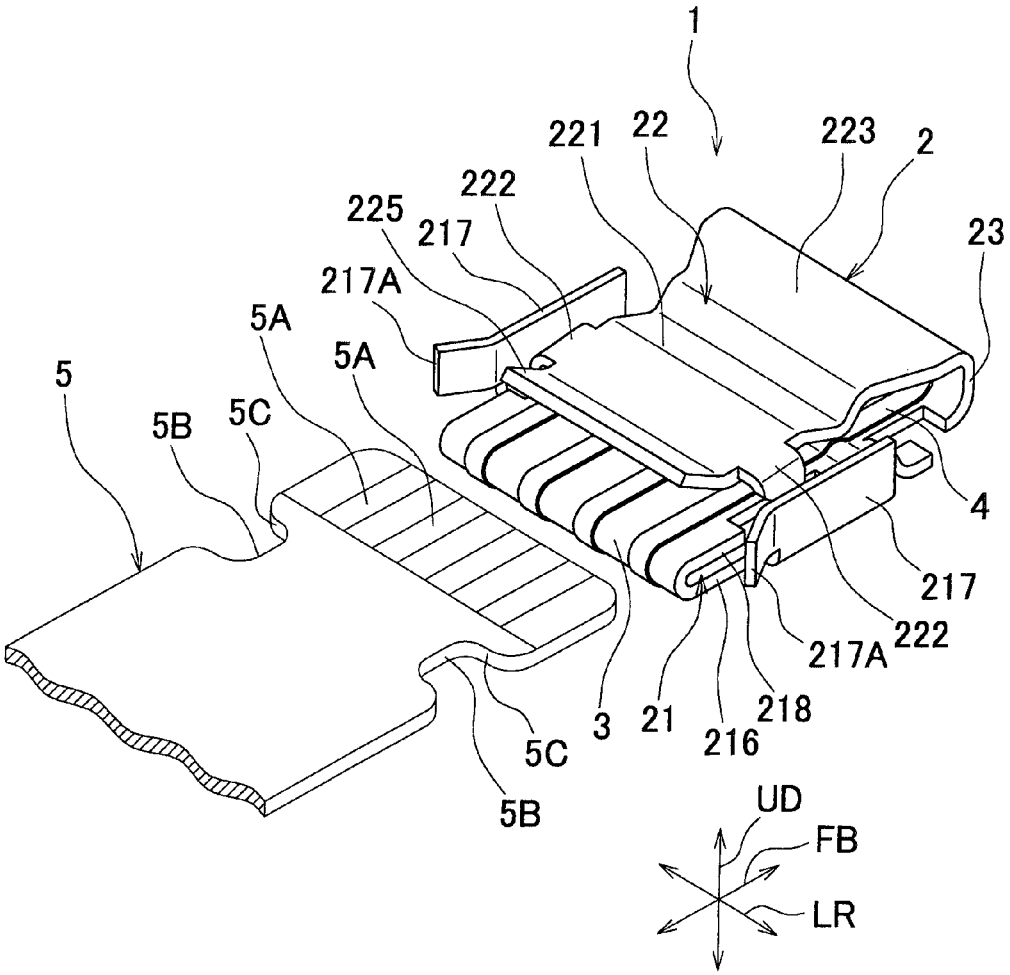
FIG. 8 is a perspective view of the connector shown in FIG. 1 and an FPC in a state before the FPC is inserted into the connector.
Figure 9:
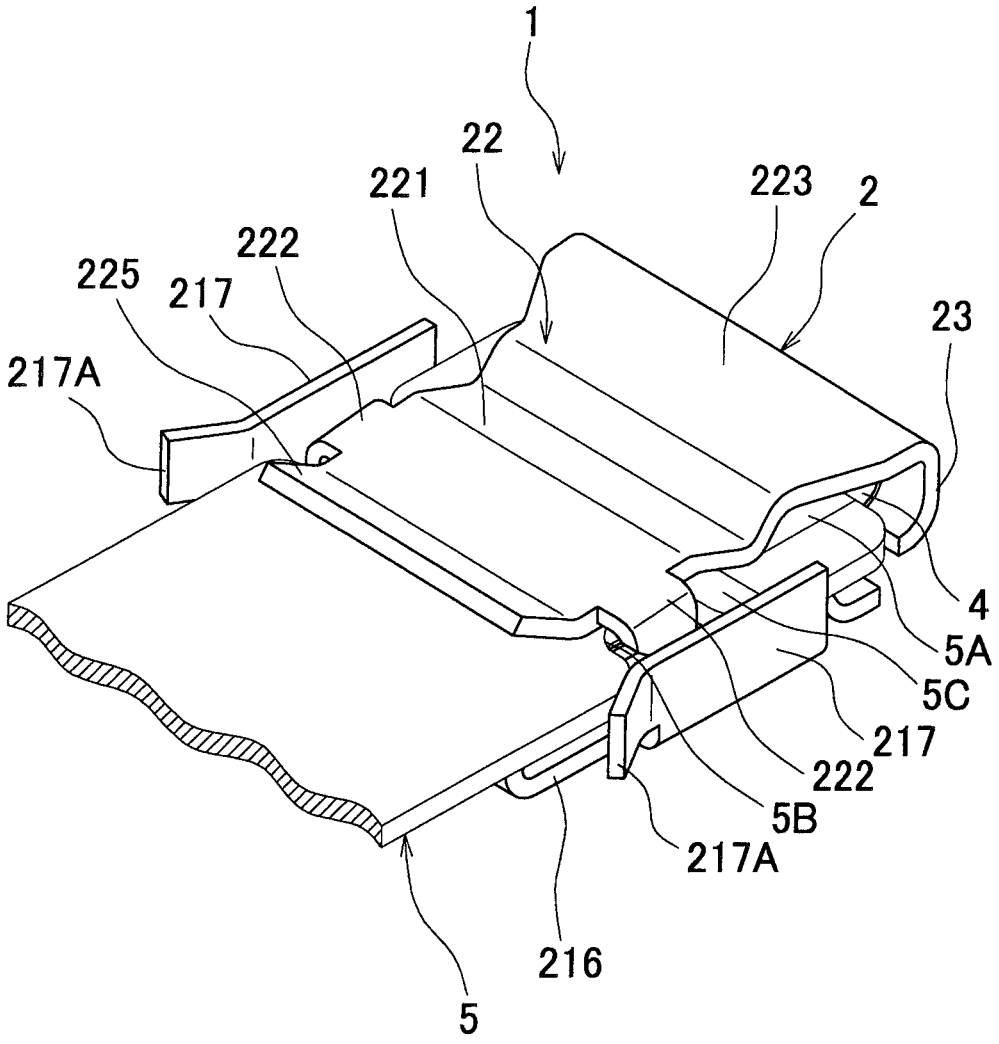
FIG. 9 is a perspective view of the connector shown in FIG. 1 and the FPC in a state after the FPC has been inserted into the connector.
Figure 10:
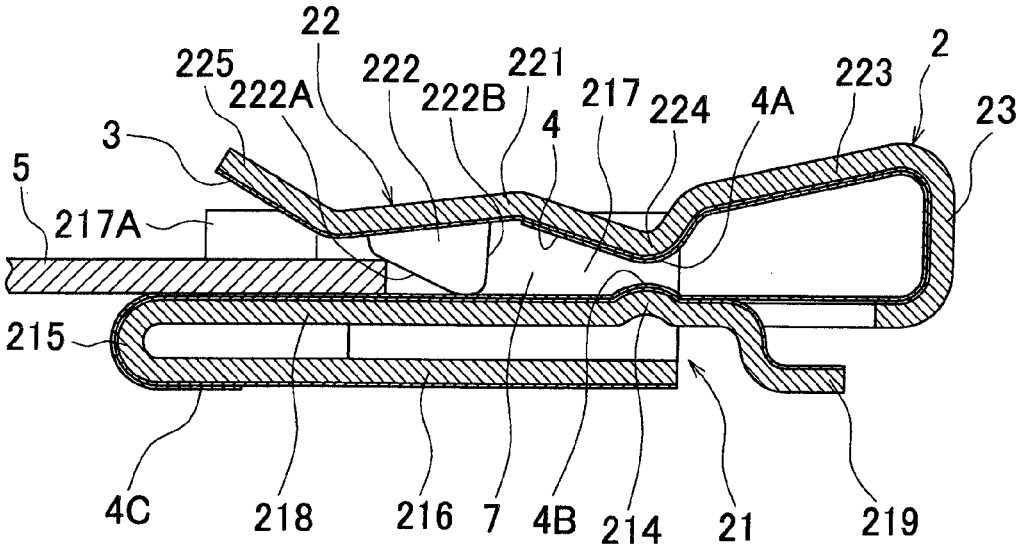
FIG. 10 is a cross-sectional view taken along VI-VI in FIG. 2, which shows a state in which a front end of the FPC has been brought into contact with locking pieces.
Figure 11:
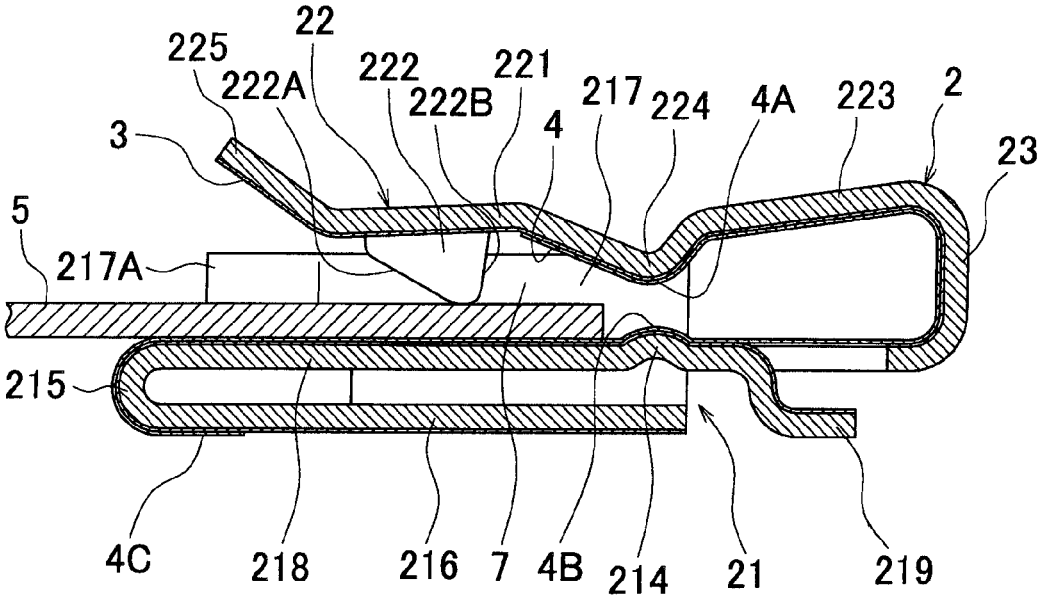
FIG. 11 is a cross-sectional view of the connector shown in FIG. 1 and the FPC in a state in which the locking pieces have climbed onto the FPC and a second movable portion has been moved in a direction away from a first supporting portion.
Figure 12:
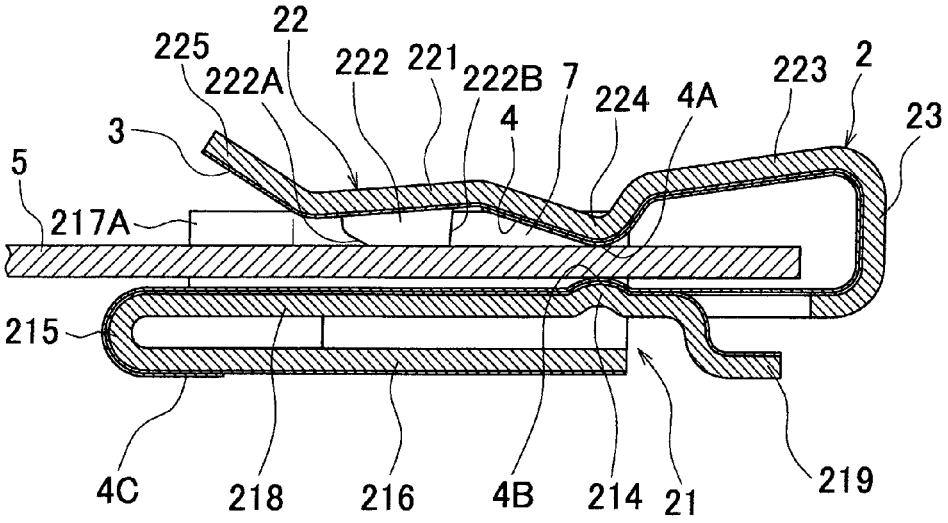
FIG. 12 is a cross-sectional view of the connector and the FPC in a state in which insertion of the FPC has been completed.
Figure 13:
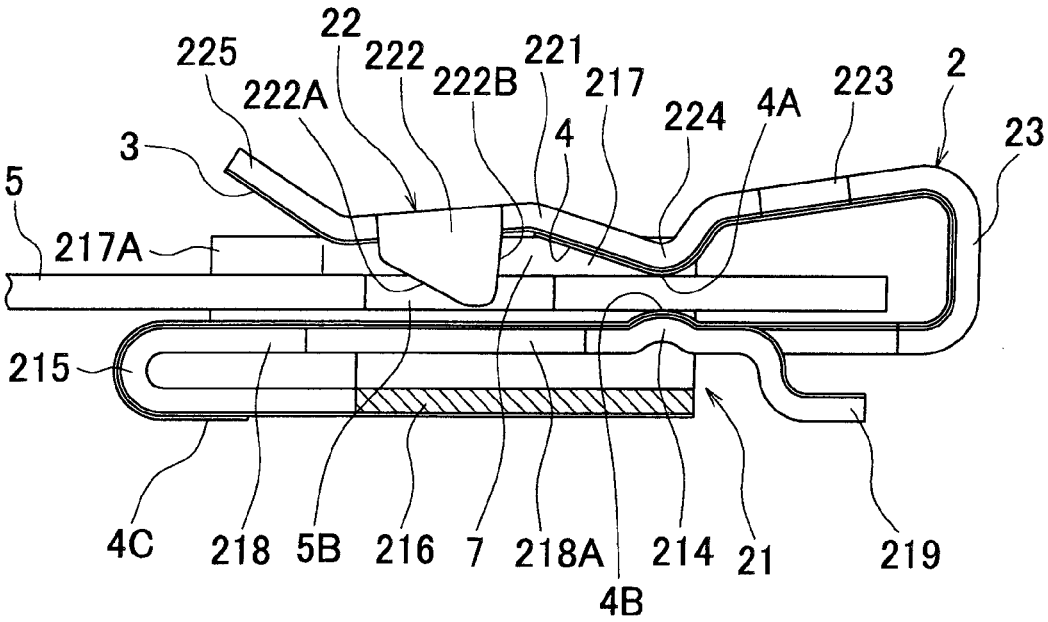
FIG. 13 is a cross-sectional view taken along IV-IV in FIG. 2, which shows the state in which insertion of the FPC has been completed.

As shown in FIGS. 6, 8, and 9, the connector 1 is used for electrically connecting between an FPC (Flexible Printed Circuit) 5, which is an example of a plate-shaped object to be connected, and a printed wiring board (the other object to be connected) 6.

Figure 1:
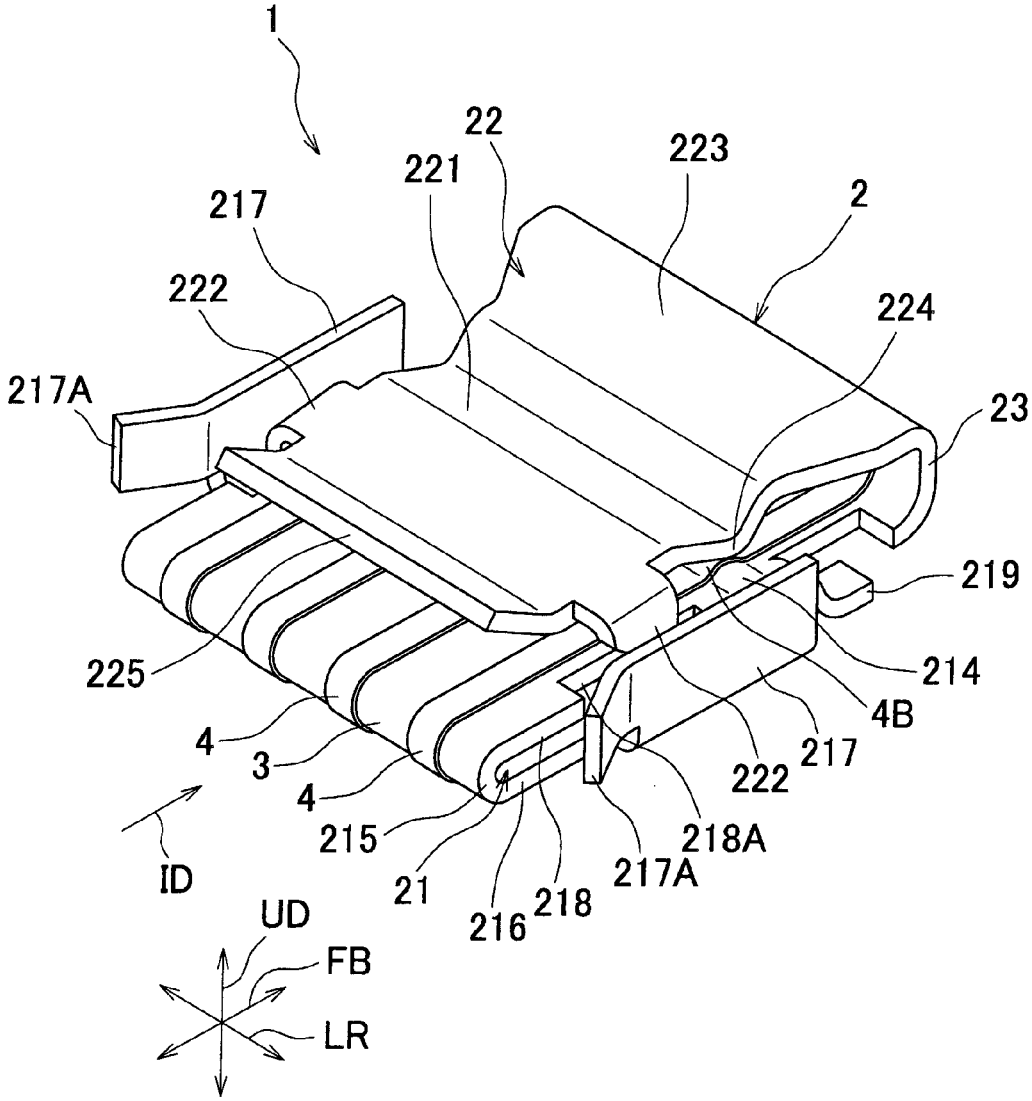
FIG. 1 is a perspective view of a connector according to an embodiment of the present invention.
Figure 7:
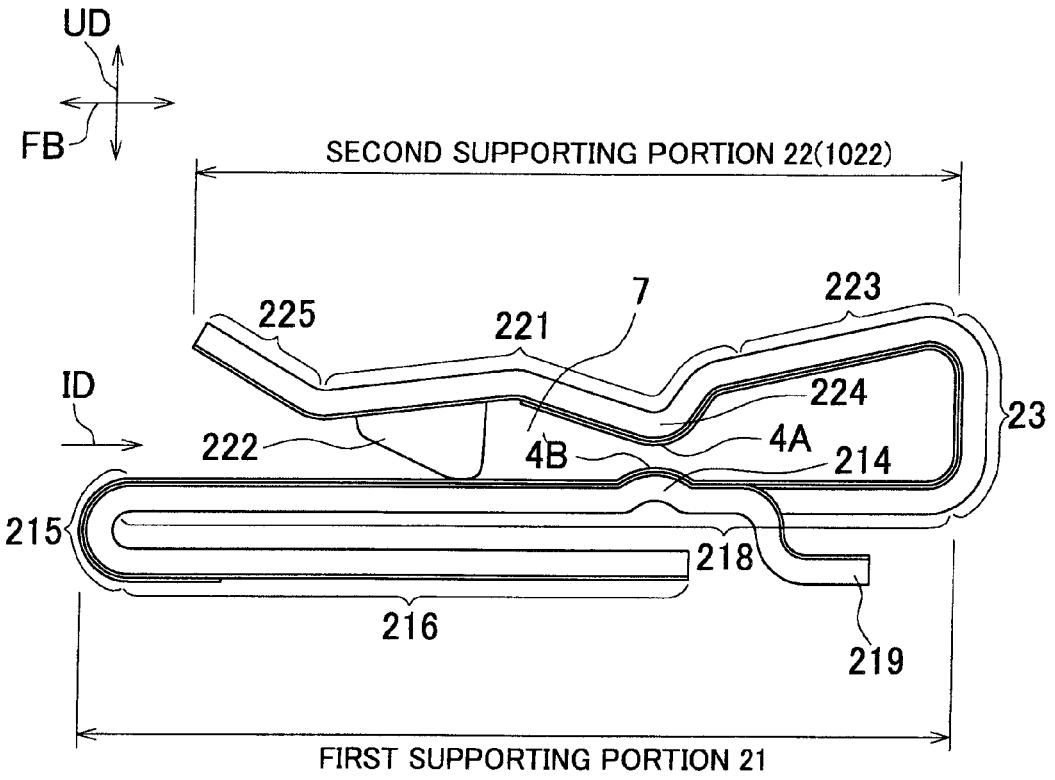
FIG. 7 is a concept diagram of the connector shown in FIG. 1.

Referring to FIG. 1, the connector 1 comprises a metal plate 2 that supports the FPC 5 (see FIG. 8) in a sandwiching manner, and a plurality of conductive path portions 4 formed on the metal plate 2 with an insulating layer 3 provided therebetween. As shown in FIGS. 6 and 7, the metal plate 2 includes a first supporting portion 21 mounted on the printed wiring board 6, and a second supporting portion 22 linked to the first supporting portion 21 via a linking portion 23 in a manner movable in a direction UD of sandwiching the FPC 5 (vertical direction of the connector 1). An accommodation space 7 for accommodating the FPC 5 is formed between the first supporting portion 21 and the second supporting portion 22. A left side as viewed in FIGS. 6 and 7 is the front side of the connector 1, and a right side as viewed in FIGS. 6 and 7 is the rear side of the connector 1. Further, FIG. 7 is a concept diagram illustrating the respective ranges of the first supporting portion 21, the second supporting portion 22, and the linking portion 23 which form the metal plate 2 shown in FIG. 6. In FIG. 7, for convenience of explanation, not only hatching but also illustration of side wall portions 217 is omitted.

As shown in FIGS. 1, 6 and 7, the metal plate 2 is S-shaped, as viewed from a direction LR of arranging the conductive path portions 4 (left-right direction of the connector 1), and the first supporting portion 21 is U-shaped, as viewed from the direction LR of arranging the conductive path portions 4.

Referring to FIGS. 1, 6 and 7, the first supporting portion 21 includes a first supporting portion body 218 which is opposed to the second supporting portion 22 in the direction UD of sandwiching the FPC 5, a fixing portion 216 which is fixed to the printed wiring board 6, a first linking portion 215 which links between the first supporting portion body 218 and the fixing portion 216, a holddown portion 219 which is fixed to the printed wiring board 6 and supports the first supporting portion body 218, a protruding portion 214 which urges contact point portions 4B of the conductive path portions 4 (parts of the conductive path portions 4) against the FPC 5 inserted into the accommodation space 7, and the side wall portions 217, forming a pair, which suppress displacement of the FPC 5 inserted into the accommodation space 7 (displacement of the FPC 5 in the direction LR of arranging the conductive path portions 4).

Figure 4:
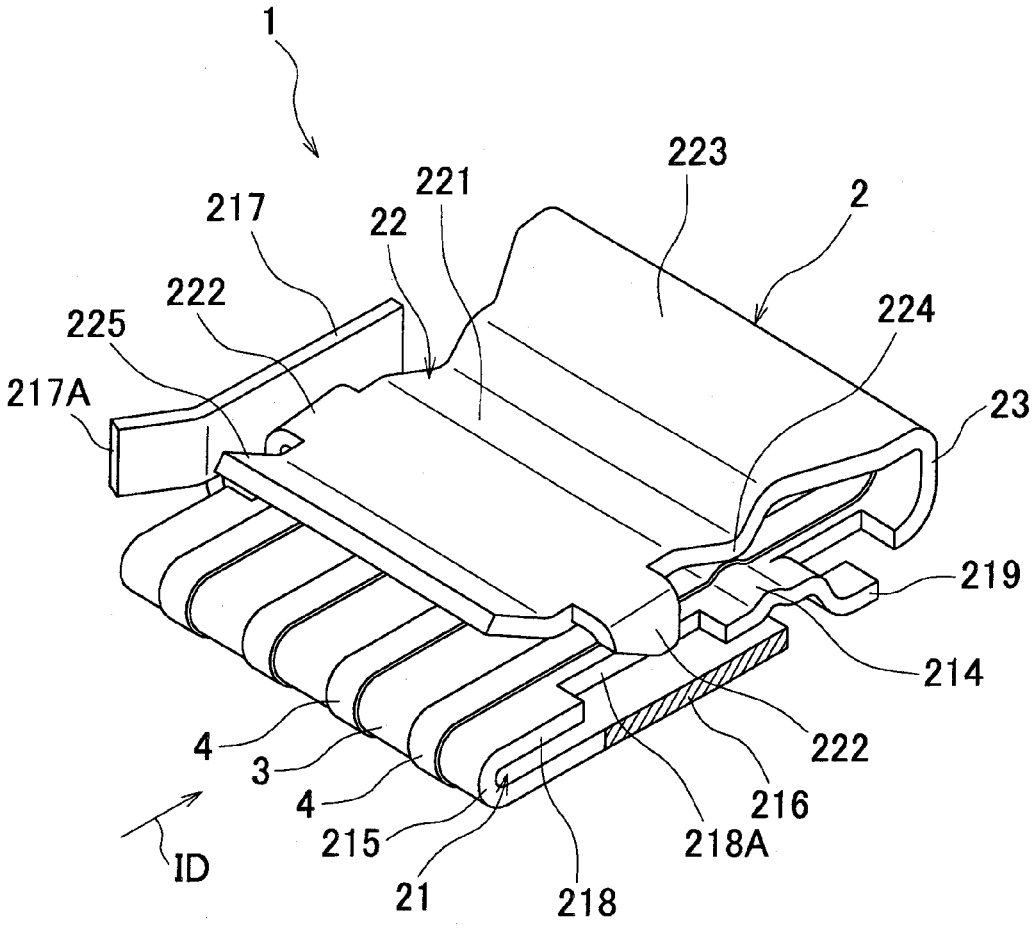
FIG. 4 is a perspective view of the connector shown in FIG. 1 in a state cut along IV-IV in FIG. 2.
Figure 5:
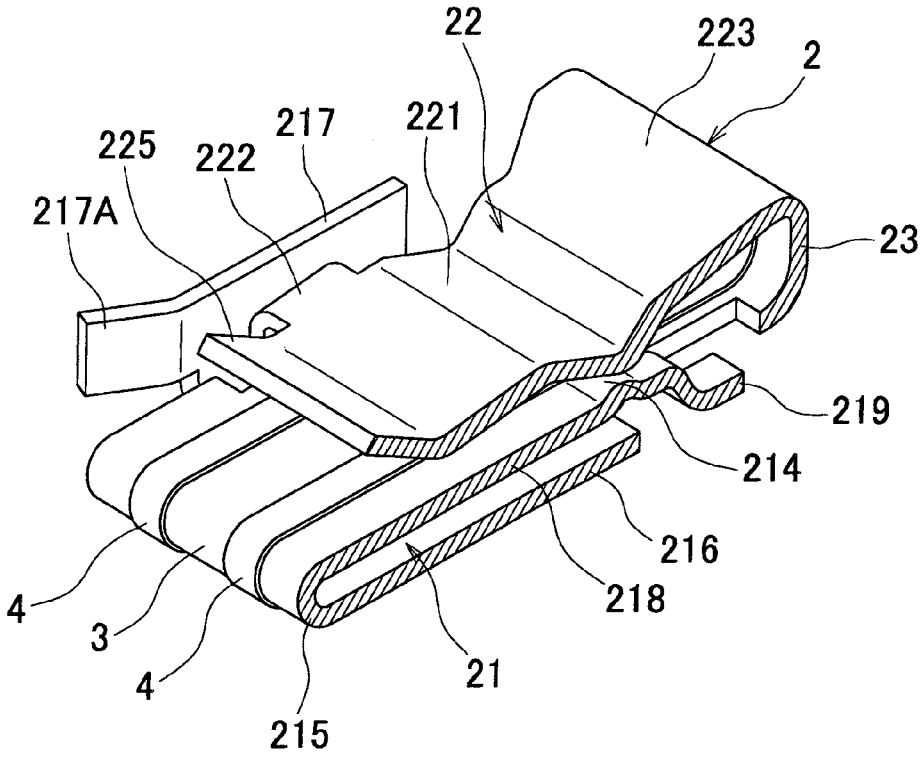
FIG. 5 is a perspective view of the connector shown in FIG. 1 in a state cut along V-V in FIG. 2.

Cutouts 218A for avoiding interference between the first supporting portion body 218 and locking pieces 222, described hereinafter, are formed in the opposite ends of the first supporting portion body 218 (opposite ends in the direction LR of arranging the conductive path portions 4) (see FIG. 4).

The fixing portion 216 is opposed to the first supporting portion body 218 in the direction UD of sandwiching the FPC 5 (see FIGS. 6 and 7).

The holddown portion 219 is fixed to the printed wiring board 6 by soldering. This causes the holddown portion 219 to cooperate with the first linking portion 215 to hold constant the position of the first supporting portion body 218 in the direction of height thereof, and makes it possible to reduce a fear that portions of the conductive path portions 4 soldered to the printed wiring board 6 come off from the printed wiring board 6 due to flapping or the like caused by inserting the FPC 5 into the accommodation space 7.

Figure 2:
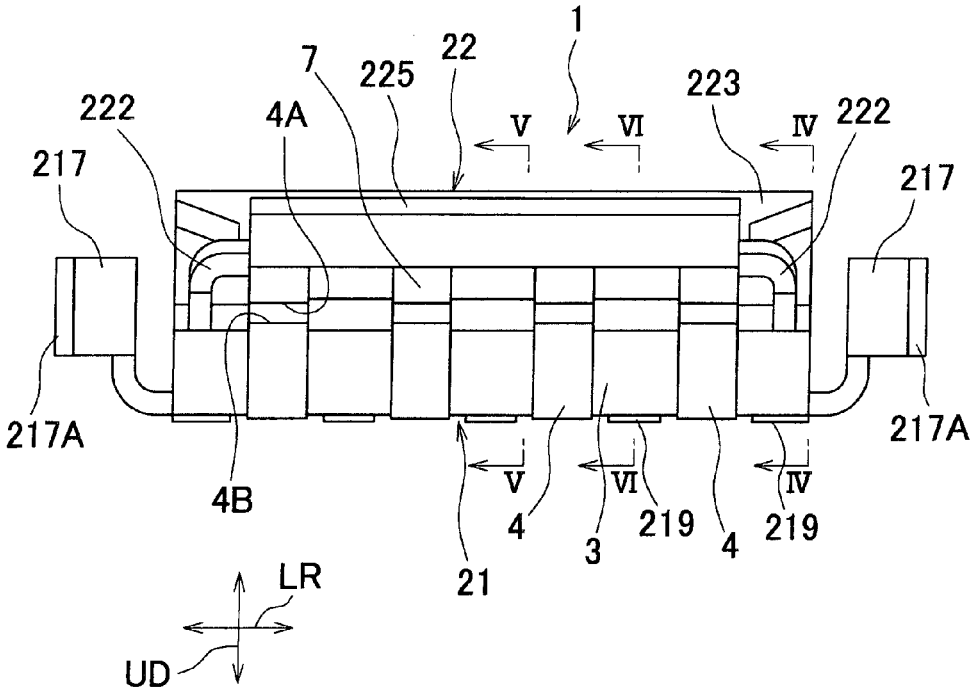
FIG. 2 is a front view of the connector shown in FIG. 1.
Figure 3:
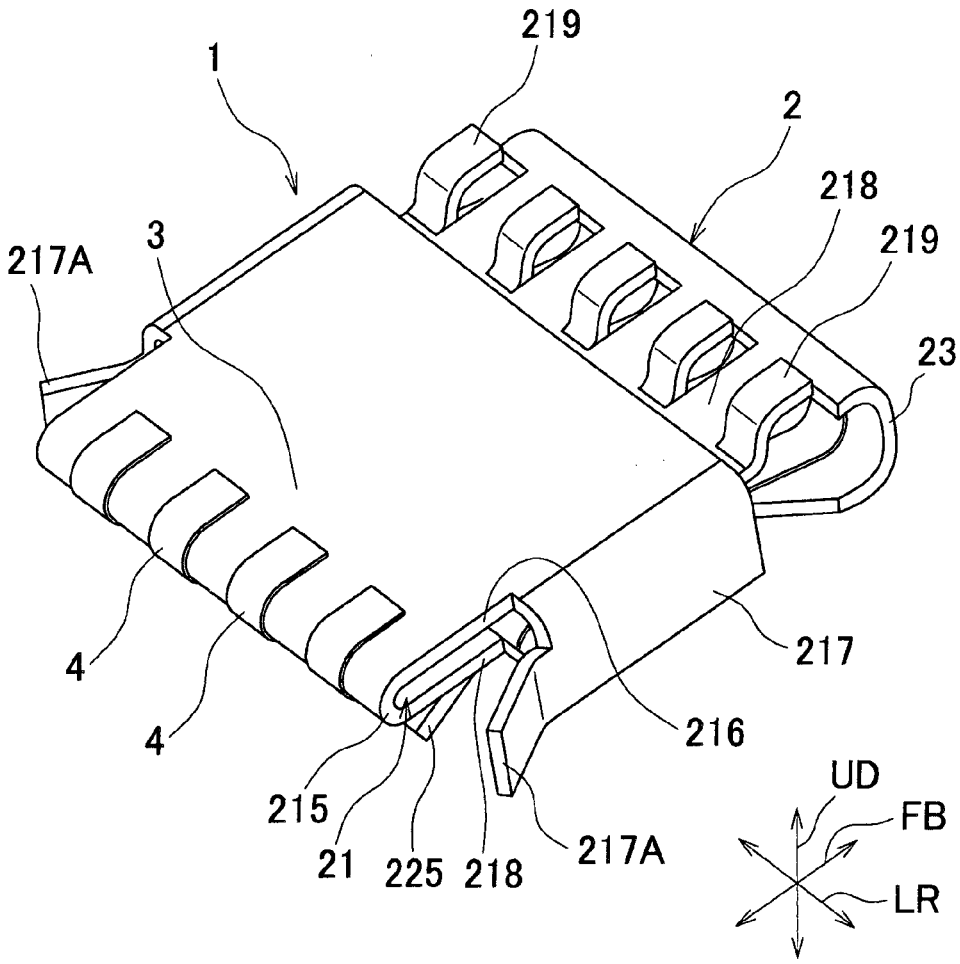
FIG. 3 is a perspective view of the connector shown in FIG. 1, as viewed obliquely from below.

The pair of side wall portions 217 are connected to the opposite ends (opposite ends in the direction LR of arranging the conductive path portions 4) of the fixing portion 216 (see FIGS. 1 and 2).

As shown in FIGS. 6 and 7, the second supporting portion 22 includes a second movable portion 221 which is opposed to the first supporting portion body 218 of the first supporting portion 21 in the direction UD of sandwiching the FPC 5, the locking pieces 222 forming a pair (each serving as a force application portion and also as a locking portion), which receive an insertion force of the FPC 5 inserted into the accommodation space 7 and thereby cause the second movable portion 221 to move in a direction away from the first supporting portion 21, and also prevent the FPC 5 completely inserted into the accommodation space 7 from being removed, a second spring portion 223 which causes the second movable portion 221 to be urged against the FPC 5 when the FPC 5 has been inserted into the accommodation space 7, a protruding portion 224 which presses contact point portions 4A of the conductive path portions 4 (parts of the conductive path portions 4) against the FPC 5 inserted into the accommodation space 7, and a guiding portion 225 which guides the FPC 5 into the accommodation space 7.

Each of the side wall portions 217 is bent upward substantially at right angles to the fixing portion 216 (see FIGS. 8 and 9). The side wall portions 217 each include a guiding portion 217A which guides the FPC 5 into the accommodation space 7.

When the FPC 5 is inserted into the accommodation space 7 against the returning force of the second spring portion 223, the pair of locking pieces 222 cause the second movable portion 221 to move in the direction away from the first supporting portion 21 to increase a distance between the first supporting portion 21 and the second movable portion 221, and when the insertion of the FPC 5 has been completed, the locking pieces 222 enter cutouts 5B of the FPC 5, to allow the second movable portion 221 to move toward the first supporting portion 21 by the returning force of the second spring portion 223.

The pair of locking pieces 222 are linked to the respective opposite ends of the second movable portion 221 (opposite ends in the direction LR of arranging the conductive path portions 4). The locking pieces 222 are bent downward substantially at right angles to the second movable portion 221 (see FIG. 2). As shown in FIGS. 6 and 7, the locking pieces 222 have a substantially right triangle shape, as viewed from the direction LR of arranging the conductive path portions 4. An inclined surface 222A is formed on the front side of each locking piece 222 (front side in a front-rear direction FB of the connector 1), and a stopper surface 222B is formed on the rear side of the locking piece 222 (rear side in the front-rear direction FB of the connector 1). The inclined surface 222A obliquely intersects with a direction ID of inserting the FPC 5 and also faces obliquely downward. The stopper surface 222B is substantially orthogonal to the direction ID of inserting the FPC 5 such that the FPC 5 can be prevented from being removed. The stopper surfaces 222B prevent the FPC 5 from being removed, by receiving a force in a direction in which the FPC 5 is removed (direction opposite to the direction ID of inserting the FPC 5) to thereby function as a locking portion. As a consequence, a state in which the insertion of the FPC 5 has been completed is maintained.

The guiding portion 225 is located forward of the second movable portion 221 (forward in the front-rear direction FB of the connector 1) (see FIG. 6).

As shown in FIGS. 6, 7, and 10 to 13, the protruding portion 214 of the first supporting portion 21 and the protruding portion 224 of the second supporting portion 22 are opposed to each other in the direction UD of sandwiching the FPC 5. Further, the contact point portions 4B of the conductive path portions 4 on the side of the first supporting portion 21 and the contact point portions 4A of the conductive path portions 4 on the side of the second supporting portion 22 are opposed to each other in the direction UD of sandwiching the FPC 5.

The locking pieces 222 are located toward a front end of the second movable portion 221 (front end in the front-rear direction FB of the connector 1), and the contact point portions 4A and 4B of the conductive path portions 4 are located toward a rear end of the second movable portion 221 (rear end in the front-rear direction FB of the connector 1). The locking pieces 222 are located at positions more distant from the linking portion 23 than the contact point portions 4A and 4B are. Therefore, the locking pieces 222 are pushed up with a small insertion force of the FPC 5.

As shown in FIG. 6, the conductive path portions 4 are formed on the metal plate 2 with the insulating layer 3 provided therebetween. The conductive path portions 4 extend from the lower surface of the fixing portion 216 of the first supporting portion 21 to the lower surface of the second movable portion 221 of the second supporting portion 22. Portions of the conductive path portions 4, located on the lower surface of the fixing portion 216 are soldered to pads (not shown) on the printed wiring board 6 as connection portions 4C. Portions of the conductive path portions 4, located on the protruding portions 214 and 224 are brought into contact with terminal portions 5A formed on the opposite surfaces of the FPC 5 (only terminal portions 5A formed on one surface of the FPC 5 are shown in FIG. 8) as the contact point portions 4B and the contact point portions 4A.

Next, a description will be given of an example of a method of manufacturing the connector 1.

First, an insulating layer 3 is formed by applying a resin to one surface of a flat plate-shaped metal plate 2 having spring properties. Then, a copper thin film is laminated on the insulating layer 3, and then conductive patterns (a plurality of conductive path portions 4) are formed by etching.

After the conductive path portions 4 have been formed on the insulating layer 3, the metal plate 2 is blanked into a predetermined shape.

Finally, the metal plate 2 is bent into a shape shown in FIG. 1. An example of a procedure for bending the metal plate 2 is as follows: First, a portion of the metal plate 2, which will be formed into the second supporting portion 22, is bend into a predetermined shape, and then the whole metal plate 2 is bent into an S shape. Finally, portions of the metal plate 2, which will be formed into the side wall portions 217, are bent.

Next, a method of using the connector 1 will be described.

To electrically connect the FPC 5 to the connector 1 mounted on the printed wiring board 6, it is only required to insert the FPC 5 into the accommodation space 7 of the connector 1.

When the FPC 5 is inserted into the accommodation space 7 of the connector 1, first, a front end of the FPC 5 is brought into contact with the inclined surfaces 222A of the locking pieces 222 (see FIG. 10) to push the inclined surfaces 222A, whereby the locking pieces 222 are gradually moved upward, which causes the second movable portion 221 to move in the direction away from the first supporting portion 21.

When the FPC 5 is inserted into the accommodation space 7 of the connector 1, even if the front end of the FPC 5 is displaced with respect to an entrance of the accommodation space 7 in the direction UD of sandwiching the FPC 5 or the direction LR of arranging the conductive path portions 4, the front end of the FPC 5 is guided into the accommodation space 7 by the guiding portions 225 and 217A.

Further, the locking pieces 222 are arranged forward of the contact point portions 4A and 4B and are located toward a free end of the second supporting portion 22 (toward the front in the front-rear direction FB of the connector 1) which is displaceable in the direction UD of sandwiching the FPC 5 using the linking portion 23 as a support, so that compared with a connector (not shown), which is configured to widen a gap between the contact point portions 4A and 4B by inserting the front end of the FPC 5 between the contact point portions 4A and 4B, the connector 1 can cause the second movable portion 221 to move in a direction away from the first supporting portion 21 with a smaller insertion force of the FPC 5.

When the FPC 5 is inserted into the accommodation space 7, causing the locking pieces 222 to climb onto the FPC 5 (see FIG. 11), the gap between the contact point portions 4A and 4B becomes larger than the thickness of the FPC 5, so that the user of the connector 1 can insert the FPC 5 between the contact point portions 4A and 4B with a small insertion force of the FPC 5.

When the front end of the FPC 5 is completely inserted into the accommodation space 7 (see FIGS. 12 and 13), the locking pieces 222 enter the cutouts 5B of the FPC 5 by the returning force of the second spring portion 223 (see FIG. 13), whereby the second movable portion 221 is moved toward the first supporting portion 21. As a consequence, the gap between the contact point portions 4A and 4B becomes smaller, and the FPC 5 is sandwiched between the contact point portions 4A and 4B, with predetermined contact forces generated between the FPC 5 and the contact point portion 4A and between the FPC 5 and the contact point portion 4B. The FPC 5 and the printed wiring board 6 are thus electrically connected to each other.

Further, when the front end of the FPC 5 is completely inserted into the accommodation space 7 of the connector 1 (see FIGS. 12 and 13), the locking pieces 222 enter the cutouts 5B of the FPC 5, and therefore even when a force for pulling out the FPC 5 from the connector 1 is generated due to some cause, stopper portions 5C (see FIG. 8) of the FPC 5 are brought into abutment with stopper surfaces 222*b* of the locking pieces 222, whereby the FPC 5 is prevented from being removed. This maintains the state of the FPC 5 in which insertion thereof has been completed.

According to the connector 1 of the present embodiment, it is possible to dispense with an actuator and thereby reduce the number of component parts, and hence it is possible to reduce manufacturing costs of the connector.

Figure 19:
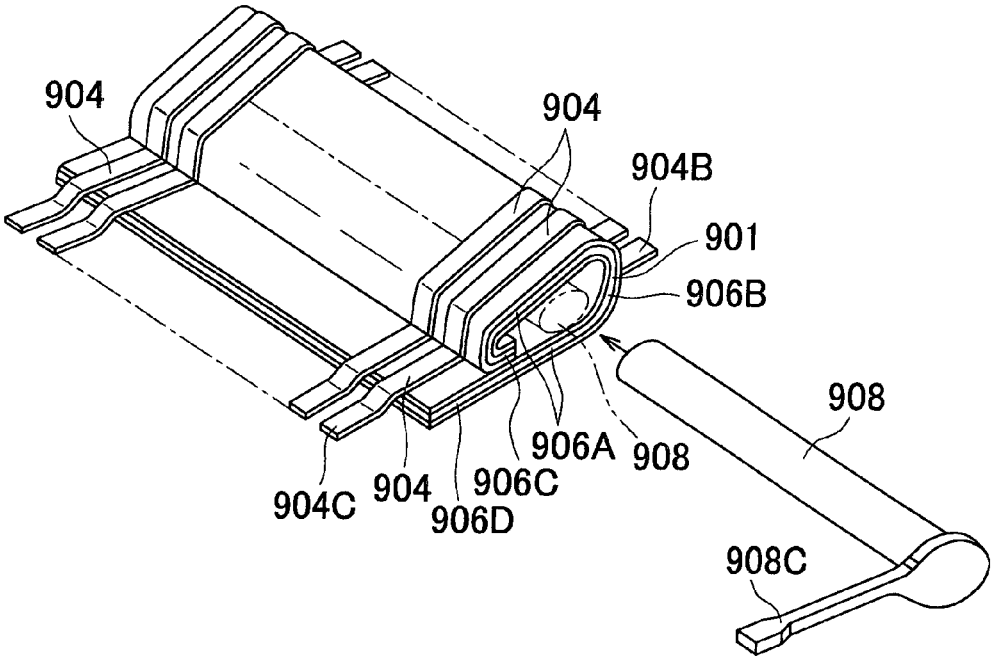
FIG. 19 is a perspective view of an example of a double-sided contact-type connector.
Figure 20A:
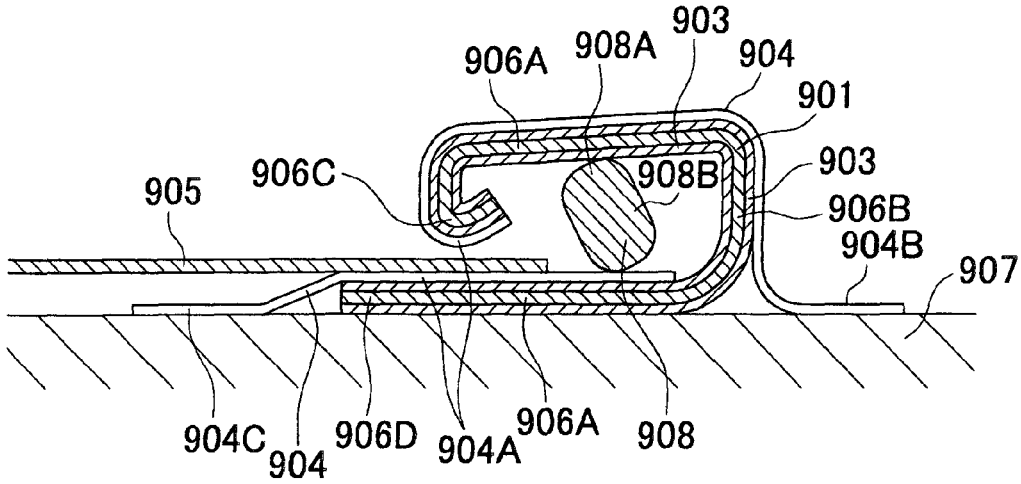
Figure 20B:
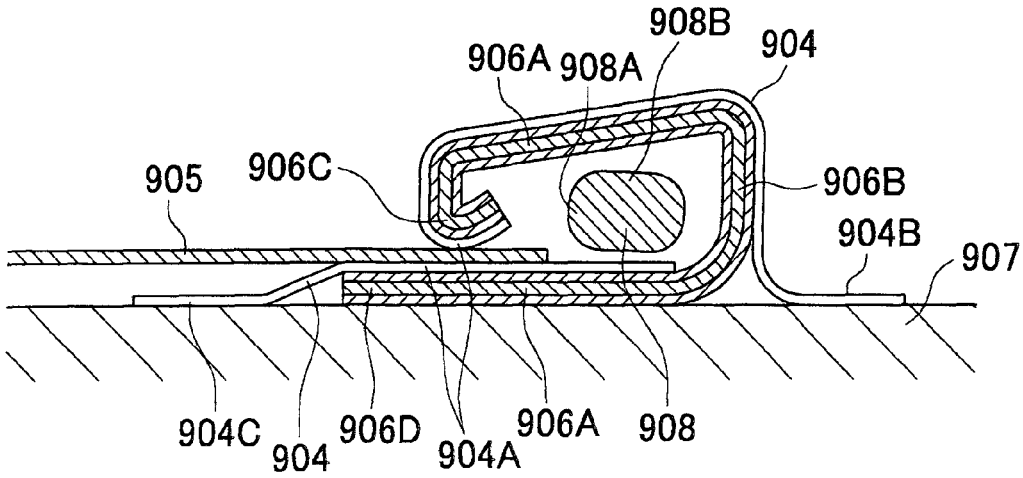

Further, since it is possible to electrically connect the FPC 5 to the connector 1 by one action of inserting the front end of the FPC 5 into the accommodation space 7 of the connector 1, the connector 1 is more excellent in operability than the connector including the actuator shown in FIGS. 19, 20A, and 20B.

Furthermore, since the locking pieces 222 are arranged forward of the contact point portions 4A and 4B (the protruding portions 224 and 214) (forward in the front-rear direction FB of the connector 1), it is possible to make the insertion force of the FPC 5 smaller than a connector (not shown) which is configured to widen the gap between the contact point portions 4A and 4B by pushing and inserting the front end of the FPC 5 between the contact point portions 4A and 4B.

Further, since the locking pieces 222 are pushed up by insertion of the FPC 5, whereby the gap between the contact point portions 4A and 4B is increased, no large contact forces are generated between the conductive path portions 4 and the terminal portions 5A of the FPC 5, which makes the conductive path portions 4 and the terminal portions 5A of the FPC 5 difficult to wear away.

Next, a connector 101 according to a first variation of the present invention will be described with reference to FIG. 14.

The same components as those of the connector according to the embodiment shown in FIG. 1 are denoted by the same reference numerals, and detailed description thereof is omitted. The following description will be given of only different components from those of the embodiment shown in FIG. 1.

Figure 14:
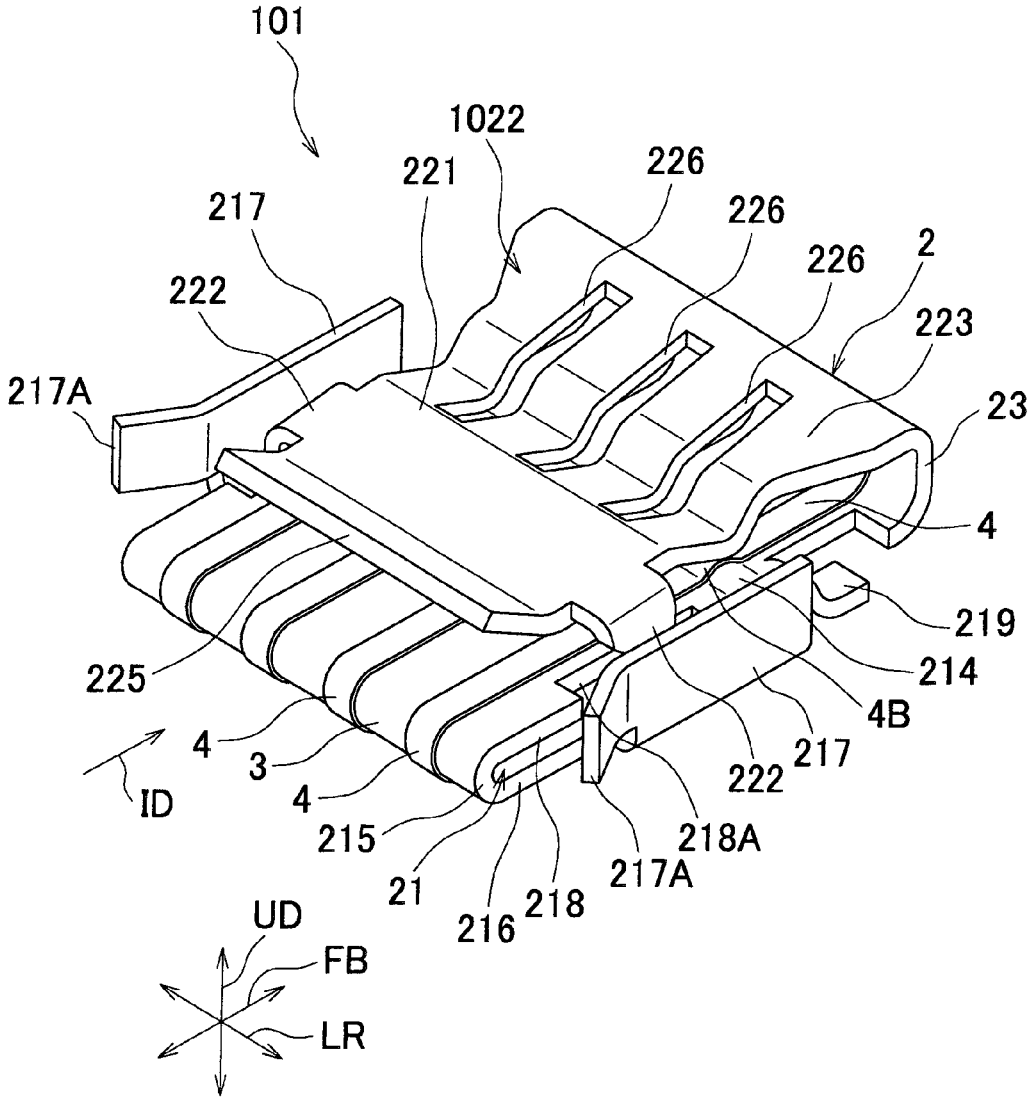
FIG. 14 is a perspective view of a connector according to a first variation of the embodiment.

In the connector 101 according to the first variation, as shown in FIG. 14, a second supporting portion 1022 includes a plurality of slots 226. The slots 226 extend from the second movable portion 221 to the second spring portion 223 along the direction ID of inserting the FPC 5. The slots 226 are formed through the second supporting portion such that they are open between the conductive path portions 4 on the lower surface of the second supporting portion 1022.

According to the connector 101 of the first variation, it is possible to provide the same advantageous effects as provided by the embodiment shown in FIG. 1, and since part of the second movable portion 221 and part of the second spring portion 223 are divided into the number of the conductive path portions 4 (four in this variation), and the divided individual second movable portions 221 and second spring portions 223 are deformed independently of each other, which improves the contact stability between the contact point portions 4A and 4B of the conductive path portions 4 and the terminal portions 5A of the FPC 5.

Next, a connector 201 according to a second variation of the present invention will be described with reference to FIGS. 15 and 16.

The same components as those of the connector according to the embodiment shown in FIG. 1 are denoted by the same reference numerals, and detailed description thereof is omitted. The following description will be given of only different components from those of the embodiment shown in FIG. 1. Note that FIG. 16 is a concept diagram illustrating the respective ranges of a first supporting portion 2021, the second supporting portion 22, and the linking portion 23 which form the metal plate 2 shown in FIG. 15. In FIG. 16, for convenience of explanation, not only hatching but also illustration of the side wall portions 217 is omitted.

Figure 15:
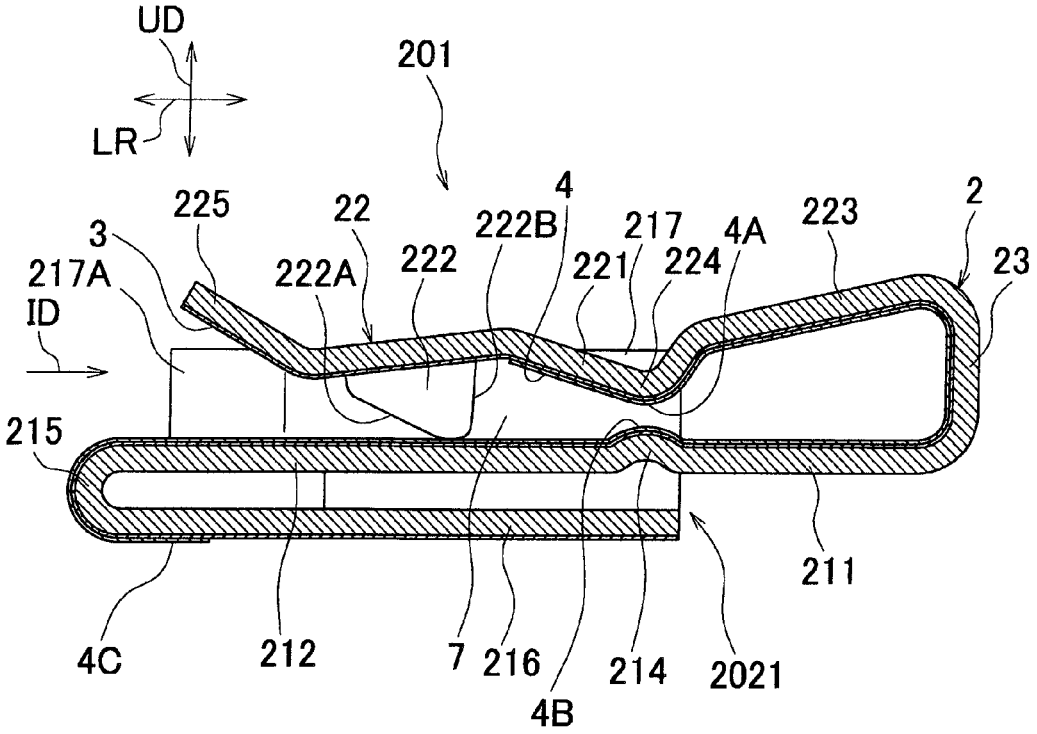
FIG. 15 is a cross-sectional view of a connector according to a second variation of the embodiment.
Figure 16:
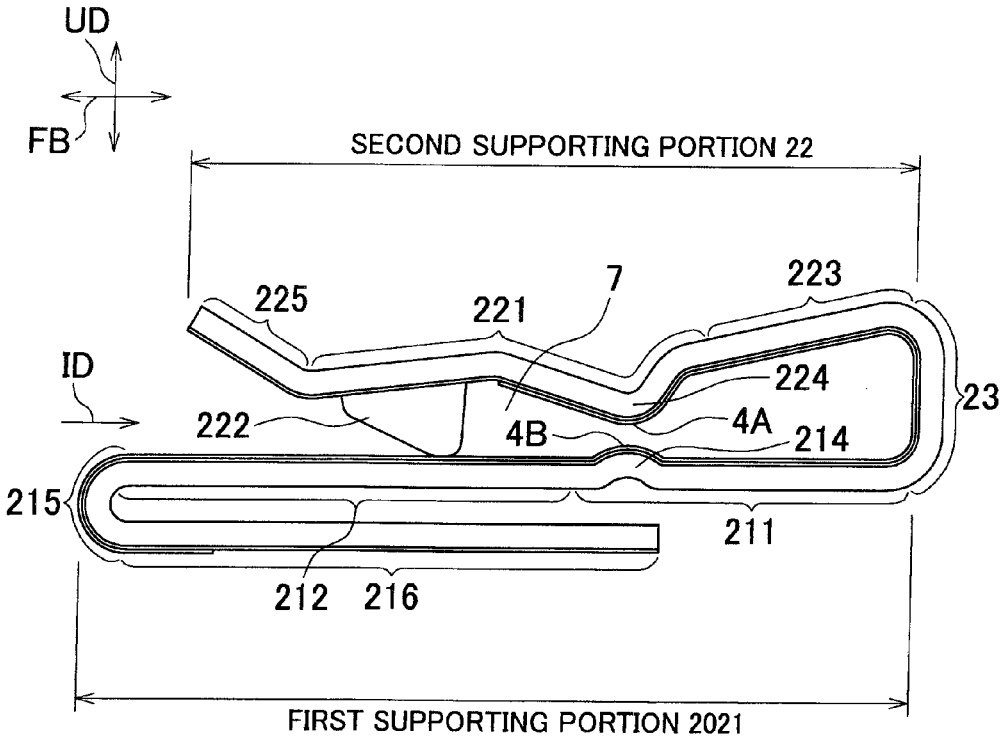
FIG. 16 is a concept diagram of the connector shown in FIG. 15.

In the connector 201 according to the second variation, as shown in FIGS. 15 and 16, the first supporting portion 2021 includes a first movable portion 211 opposed to the second supporting portion 22, the fixing portion 216 which is fixed to the printed wiring board 6, a first spring portion 212 which is linked to the fixing portion 216 via the first linking portion 215 in a manner movable in the direction UD of sandwiching the FPC 5, and causes the first movable portion 211 to be urged against the FPC 5 when the FPC 5 has been inserted into the accommodation space 7, the protruding portion 214 which presses the contact point portions 4B of the conductive path portions 4 against the FPC 5 inserted into the accommodation space 7, and the pair of side wall portions 217 which suppress displacement of the FPC 5 inserted into the accommodation space 7.

The first supporting portion 2021 does not include the holddown portion 219 of the first supporting portion 21 according to the embodiment shown in FIG. 1. The first supporting portion 2021 includes the first movable portion 211 which is moved in a direction away from the second supporting portion 22 when the FPC 5 has been inserted into the accommodation space 7.

The connector 201 according to the second variation is not provided with the holddown portion 219, so that when the FPC 5 has been inserted into the accommodation space 7, the locking pieces 222 are gradually moved upward to cause the second movable portion 221 to move in the direction away from the first supporting portion 2021, and the first spring portion 212 is pushed down to cause the first movable portion 211 to move in the direction away from the second supporting portion 22.

When the front end of the FPC 5 is completely inserted into the accommodation space 7, the locking pieces 222 enter the cutouts 5B of the FPC 5, and the gap between the contact point portions 4A and 4B is made smaller by the returning force of the second spring portion 223 and the first spring portion 212, whereby the FPC 5 is sandwiched between the contact point portions 4A and 4B.

According to the connector 201 of the second variation, it is possible to provide the same advantageous effects as provided by the embodiment shown in FIG. 1.

Next, a connector 301 according to a third variation of the present invention will be described with reference to FIGS. 17 and 18.

The same components as those of the connector according to the embodiment shown in FIG. 1 are denoted by the same reference numerals, and detailed description thereof is omitted. The following description will be given of only different components from those of the embodiment shown in FIG. 1. Note that FIG. 18 is a concept diagram illustrating the respective ranges of a first supporting portion 3021, the second supporting portion 22, and the linking portion 23 which form the metal plate 2 shown in FIG. 17. In FIG. 18, for convenience of explanation, not only hatching but also illustration of the side wall portions 217 is omitted.

Figure 17:
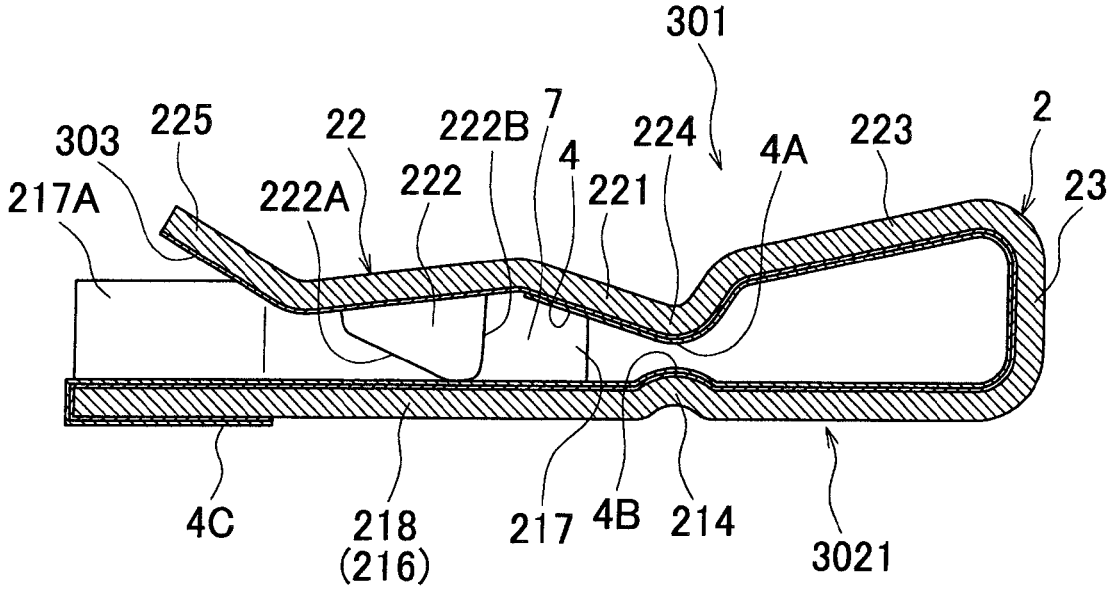
FIG. 17 is a cross-sectional view of a connector according to a third variation of the embodiment.
Figure 18:
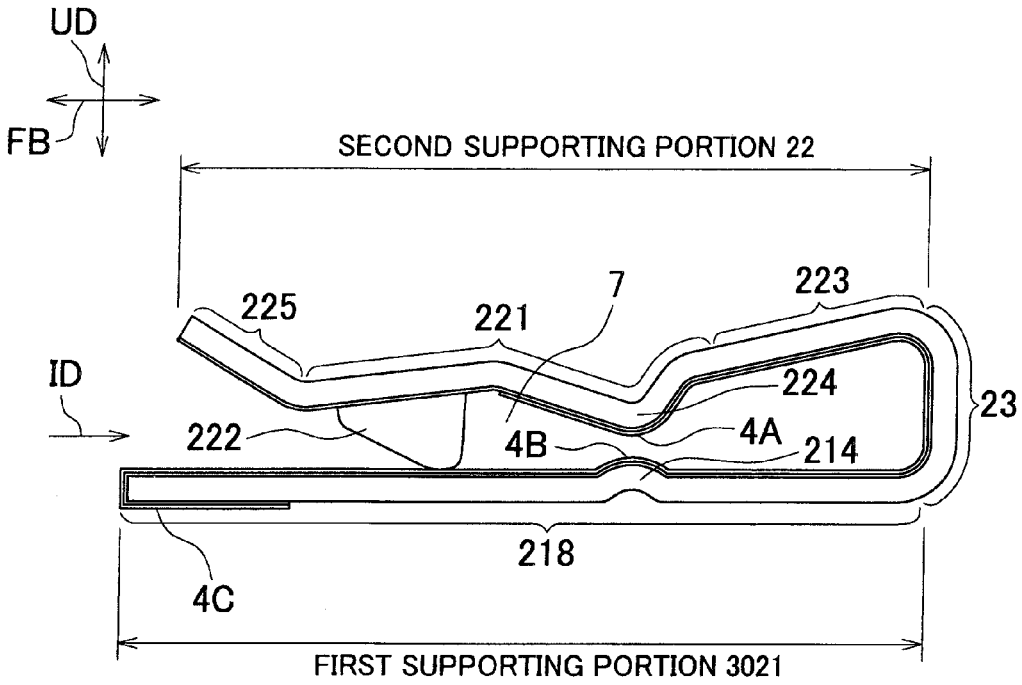
FIG. 18 is a concept diagram of the connector shown in FIG. 17.

In the connector 301 according to the third variation, as shown in FIGS. 17 and 18, the metal plate 2 is U-shaped, as viewed from the direction LR of arranging the conductive path portions 4, and the first supporting portion 3021 is I-shaped, as viewed from the direction LR of arranging the conductive path portions 4.

The first supporting portion 3021 includes the first supporting portion body 218 which is opposed to the second supporting portion 22 in the direction UD of sandwiching the FPC 5, the protruding portion 214 which causes the contact point portions 4B of the conductive path portions 4 to be urged against the FPC 5 inserted into the accommodation space 7, and the pair of side wall portions 217 which suppress displacement of the FPC 5 inserted into the accommodation space 7.

The first supporting portion 3021 include none of the fixing portion 216, the first linking portion 215, and the holddown portion 219, which are included in the first supporting portion 21 according to the embodiment shown in FIG. 1. The first supporting portion body 218 of the first supporting portion 3021 also serves as the fixing portion 216.

In the connector 301 according to the third variation, a piece of insulating film (insulating layer) 303 having a conductive pattern (a plurality of conductive path portions 4) patterned thereon is affixed to opposite surfaces of the metal plate 2. The insulating film 303 extends from a lower surface of the guiding portion 225 of the second supporting portion 22 to a lower surface of the first supporting portion body 218 of the first supporting portion 3021.

The first supporting portion body 218 is fixed to the printed wiring board 6. Portions of the conductive path portions 4, located on the lower surface of the first supporting portion body 218, are soldered to the printed wiring board 6 as the connection portions 4C.

According to the connector 301 of the third variation, it is possible to provide the same advantageous effects as provided by the embodiment shown in FIG. 1, and reduce the height of the connector.

Although in the above-described embodiment and variations, the locking pieces 222 serve as both force application portions and locking portions, the force application portions and the locking portions may be divided. More specifically, for example, dedicated force application portions (not shown) for causing the second movable portion 221 to move in the direction away from the first supporting portion 21, 2012, or 3012 so as to increase the distance between the contact point portions 4A and 4B may be formed in a front-side portion of the connector in the front-rear direction (FB), and dedicated locking portions (not shown) for maintaining the state of the FPC 5 in which insertion thereof has been completed may be formed in a rear-side portion of the connector in the front-rear direction (FB), whereby the force application portions and the locking portions may be formed in a divided manner such that the force application portions (not shown) and the locking portions (not shown) are arranged in the front-rear direction (FB) of the connector.

Further, although in the above-described embodiment and variations, the protruding portions 214 and 224 are formed on both the first supporting portions 21, 2012, and 3021 and the second supporting portions 22 and 1022, only the protruding portion 214 on the first supporting portions 21, 2012, and 3021 may be formed, or only the protruding portion 224 on the second supporting portions 22 and 1022 may be formed.

It is further understood by those skilled in the art that the foregoing are the preferred embodiments of the present invention, and that various changes and modification may be made thereto without departing from the spirit and scope thereof.

What is claimed is:

1. A connector that electrically connects a plate-shaped object to be connected and an other object to be connected to each other, comprising:

a metal plate for supporting the plate-shaped object to be connected in a sandwiching manner, said metal plate including a first supporting portion mounted on the other object to be connected, and a second supporting portion linked to said first supporting portion via a linking portion in a manner movable in a direction of sandwiching the plate-shaped object to be connected, said second supporting portion including:

a second movable portion opposed to said first supporting portion, a second spring portion for causing said second movable portion to be urged against the plate-shaped object to be connected when the plate-shaped object to be connected is inserted between said first supporting portion and said second supporting portion, and a force application portion for causing said second movable portion to move in a direction away from said first supporting portion to thereby increase a distance between said first supporting portion and said second supporting portion, when the plate-shaped object to be connected is inserted between said first supporting portion and said second movable portion against a returning force of said second spring portion, and for causing said second movable portion to move in a direction of approaching said first supporting portion, when insertion of the plate-shaped object to be connected is completed; and a plurality of conductive path portions formed on said metal plate with an insulating layer provided therebetween, wherein at least one of said first supporting portion and said second supporting portion has a protruding portion formed thereon which presses part of said conductive path portions against the plate-shaped object to be connected which has been inserted between said first supporting portion and said second movable portion.

2. The connector according to claim 1, wherein said force application portion is disposed forward of said protruding portion in a front-rear direction of the connector.

3. The connector according to claim 1, wherein said first supporting portion includes a first supporting portion body opposed to said second supporting portion in the direction of sandwiching the plate-shaped object to be connected, a fixing portion fixed to the other object to be connected, a first linking portion that links between said first supporting portion body and said fixing portion, and a holddown portion fixed to the other object to be connected, for supporting said first supporting portion body.

4. The connector according to claim 2, wherein said first supporting portion includes a first supporting portion body opposed to said second supporting portion in the direction of sandwiching the plate-shaped object to be connected, a fixing portion fixed to the other object to be connected, a first linking portion that links between said first supporting portion body and said fixing portion, and a holddown portion fixed to the other object to be connected, for supporting said first supporting portion body.

5. The connector according to claim 1, wherein said first supporting portion includes a first movable portion opposed to said second supporting portion, a fixing portion fixed to the other object to be connected, and a first spring portion linked to said fixing portion via said first linking portion in a manner movable in the direction of sandwiching the plate-shaped object to be connected, for causing said first movable portion to be urged against the plate-shaped object to be connected when the plate-shaped object to be connected is inserted between said second supporting portion and said first movable portion.

6. The connector according to claim 2, wherein said first supporting portion includes a first movable portion opposed to said second supporting portion, a fixing portion fixed to the other object to be connected, and a first spring portion linked to said fixing portion via said first linking portion in a manner movable in the direction of sandwiching the plate-shaped object to be connected, for causing said first movable portion to be urged against the plate-shaped object to be connected when the plate-shaped object to be connected is inserted between said second supporting portion and said first movable portion.

7. The connector according to claim 1, wherein said second supporting portion includes a locking portion for maintaining a state in which insertion of the plate-shaped object to be connected has been completed.

8. The connector according to claim 2, wherein said second supporting portion includes a locking portion for maintaining a state in which insertion of the plate-shaped object to be connected has been completed.

9. The connector according to claim 7, wherein said locking portion also serves as said force application portion.

10. The connector according to claim 8, wherein said locking portion also serves as said force application portion.

11. The connector according to claim 1, wherein said protruding portion is formed on each of said first supporting portion and said second supporting portion, and said protruding portion formed on said first supporting portion and said protruding portion formed on said second supporting portion are opposed to each other in the direction of sandwiching the plate-shaped object to be connected.

12. The connector according to claim 2, wherein said protruding portion is formed on each of said first supporting portion and said second supporting portion, and said protruding portion formed on said first supporting portion and said protruding portion formed on said second supporting portion are opposed to each other in the direction of sandwiching the plate-shaped object to be connected.

13. The connector according to claim 1, wherein said first supporting portion includes a pair of side wall portions for suppressing displacement of the plate-shaped object to be connected in a direction of arranging said conductive path portions.

14. The connector according to claim 2, wherein said first supporting portion includes a pair of side wall portions for suppressing displacement of the plate-shaped object to be connected in a direction of arranging said conductive path portions.

15. The connector according to claim 1, wherein said first supporting portion, said second supporting portion, and said linking portion are integrally formed with each other.

16. The connector according to claim 2, wherein said first supporting portion, said second supporting portion, and said linking portion are integrally formed with each other.

17. The connector according to claim 1, wherein said metal plate is S-shaped, as viewed from a direction of arranging said conductive path portions, and said first supporting portion is U-shaped, as viewed from the direction of arranging said conductive path portions.

18. The connector according to claim 2, wherein said metal plate is S-shaped, as viewed from a direction of arranging said conductive path portions, and said first supporting portion is U-shaped, as viewed from the direction of arranging said conductive path portions.

19. The connector according to claim 1, wherein said metal plate is U-shaped, as viewed from a direction of arranging said conductive path portions, and said first supporting portion is I-shaped, as viewed from the direction of arranging said conductive path portions.

20. The connector according to claim 2, wherein said metal plate is U-shaped, as viewed from a direction of arranging said conductive path portions, and said first supporting portion is I-shaped, as viewed from the direction of arranging said conductive path portions.

* * * * *